US007052383B2

(12) United States Patent
Sieber

(10) Patent No.: US 7,052,383 B2
(45) Date of Patent: May 30, 2006

(54) MANUAL ORBITAL SANDER

(75) Inventor: Gustav Sieber, Aichtal-Groetzingen (DE)

(73) Assignee: Robert Bosch GmbH, Stuttgart (DE)

( * ) Notice: Subject to any disclaimer, the term of this patent is extended or adjusted under 35 U.S.C. 154(b) by 197 days.

(21) Appl. No.: 10/450,987

(22) PCT Filed: Sep. 4, 2002

(86) PCT No.: PCT/DE02/03262

§ 371 (c)(1),
(2), (4) Date: Jun. 18, 2003

(87) PCT Pub. No.: WO03/049902

PCT Pub. Date: Jun. 19, 2003

(65) Prior Publication Data

US 2004/0053568 A1 Mar. 18, 2004

(30) Foreign Application Priority Data

Dec. 7, 2001 (DE) ..... 101 60 265

(51) Int. Cl.
*B24B 27/08* (2006.01)
*B24B 23/00* (2006.01)

(52) U.S. Cl. ..... 451/354; 451/357

(58) Field of Classification Search ..... 451/344, 451/351, 354, 356, 357
See application file for complete search history.

(56) References Cited

U.S. PATENT DOCUMENTS

| | | | | |
|---|---|---|---|---|
| 4,414,782 | A * | 11/1983 | Langenberg | 451/357 |
| 4,625,462 | A * | 12/1986 | Fushiya et al. | 451/357 |
| 5,885,146 | A * | 3/1999 | Cockburn | 451/357 |
| 6,039,639 | A * | 3/2000 | Pfaundler | 451/356 |
| 6,132,300 | A * | 10/2000 | Martin | 451/357 |
| 6,179,696 | B1 * | 1/2001 | Duffy | 451/357 |
| 6,705,931 | B1 * | 3/2004 | Moolenaar et al. | 451/357 |
| 2001/0003087 | A1 | 6/2001 | Inai et al. | |

FOREIGN PATENT DOCUMENTS

| | | |
|---|---|---|
| DE | 100 03 504 A | 8/2001 |
| EP | 0 953 407 A1 | 11/1999 |
| EP | 1 093 884 A2 | 4/2001 |

* cited by examiner

*Primary Examiner*—Timothy V. Eley
(74) *Attorney, Agent, or Firm*—Michael J. Striker

(57) ABSTRACT

A hand-operated orbital sander (10) with a housing (12) on which a tool (18) capable of being moved in an oscillating manner is mounted, whereby the orbital path of the tool (18) is limited by longitudinal, elastic oscillating elements that couple the tool (18) with the housing (12), said hand-operated orbital sander being made more quiet-running by the fact that the oscillating elements (170, 180) comprise two tapered areas (50, 52), in particular constrictions, positioned far off-center at a distance from each other.

3 Claims, 2 Drawing Sheets

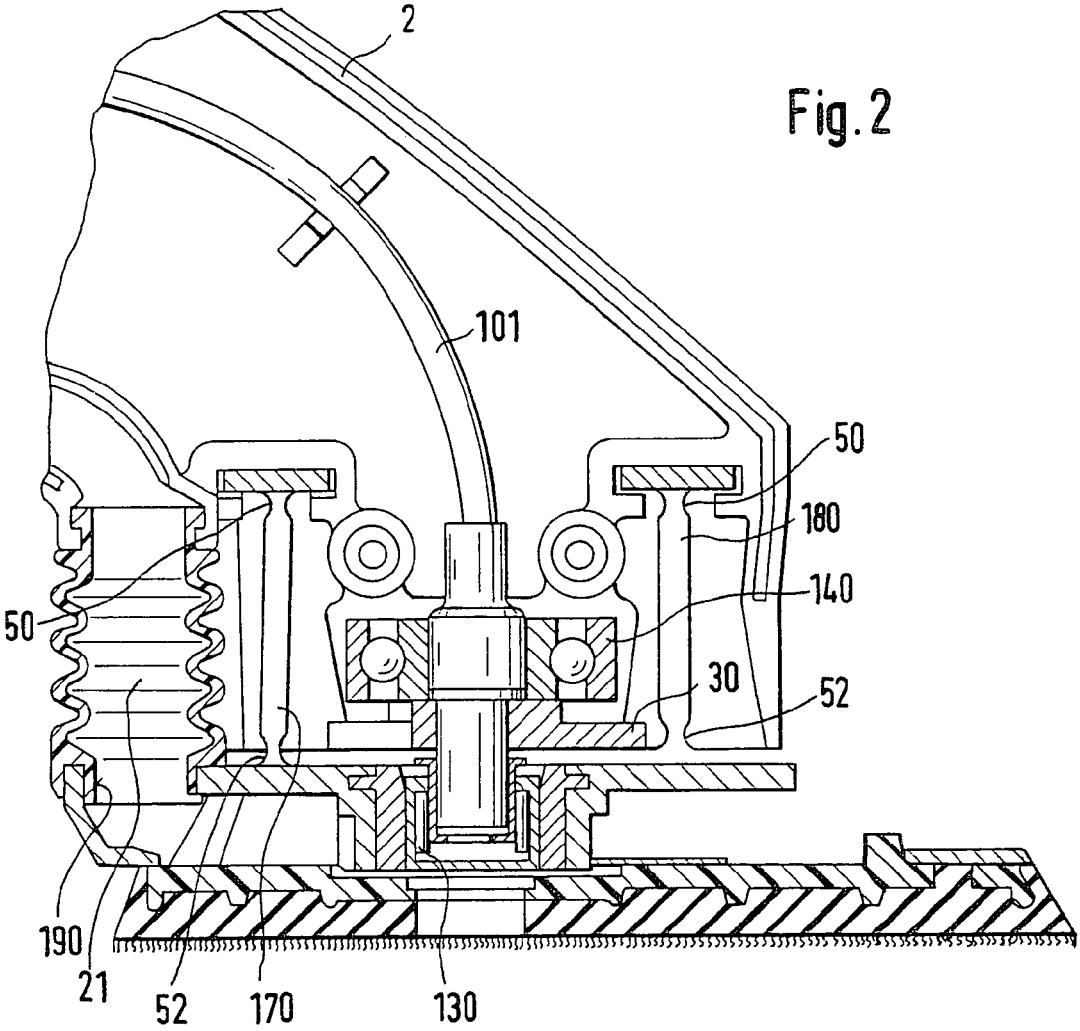
Fig. 2
Fig. 3
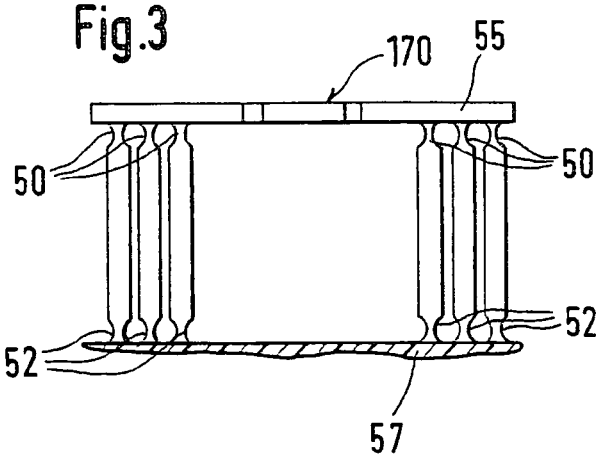
Fig. 4
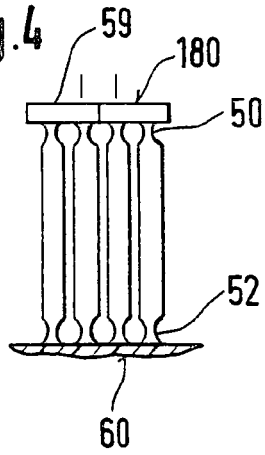

MANUAL ORBITAL SANDER

BACKGROUND OF THE INVENTION

The invention is based on a hand-operated orbital sander.

The features of the preamble of claim 1 are made known in documents EP 1 093 884 and EP 09 534 07. The hand-operated orbital sanders made known therein have longitudinal, elastic oscillating elements that couple the tool with the housing in such a manner that said tool is rotationally limited relative to said housing. Due to said elastic oscillating elements, the tool can execute an orbital oscillating motion without rotating, whereby a relatively large amount of drive energy is absorbed by the elastic oscillating elements.

A hand-operated orbital sander is made known in US 2001/000 3087 A1, the grinding tool of which is coupled with the housing via rigid oscillating elements. The rigid oscillating elements are hingedly supported, so that, as a result, the tool can execute its orbital motion as is the case with the other known hand-operated orbital sanders.

This hand-operated orbital sander is markedly more efficient than those with elastic oscillating elements. It has a greater dead weight, however, and is costlier to produce than the known machines having elastic oscillating elements.

SUMMARY OF THE INVENTION

In contrast, the hand power tool according to the invention has the advantage of being as efficient and quiet-running as the known machines, but with less weight and lower fabrication costs.

The elastic oscillating elements have a circumferential constriction on each of the opposing ends; this creates a film hinge with 360-degree action that improves the oscillating property of the oscillating elements in such a manner that they now absorb only the slightest amounts of energy from the drive motor. This markedly increases the efficiency of the machines and their service life.

The fact that the elastic oscillating elements have a base plate on each of their ends and the constrictions are located there makes the oscillating elements easy to fabricate and assemble.

The fact that the constrictions are configured as two concave, straight impressions on opposite ends of the elastic oscillating elements and a longitudinal bridge is formed makes the film hinges flexurally softer and/or more elastic transversely to the radial recesses than they are parallel to the recesses and/or in the direction of the longitudinal bridge. As a result, every point that is coupled with the oscillating elements describes small ellipses instead of small circles, enabling the abrasion characteristics of a linear sander to be more closely attained.

BRIEF DESCRIPTION OF THE DRAWINGS

The invention is described hereinbelow with reference to an associated drawing.

FIG. 2 is an enlarged section of FIG. 1.

FIG. 3 shows the rear oscillating elements, and

FIG. 4 shows the front oscillating elements of the hand-operated orbital sander according to the invention.

DETAILED DESCRIPTION OF THE PREFERRED EMBODIMENTS

Figure 1:
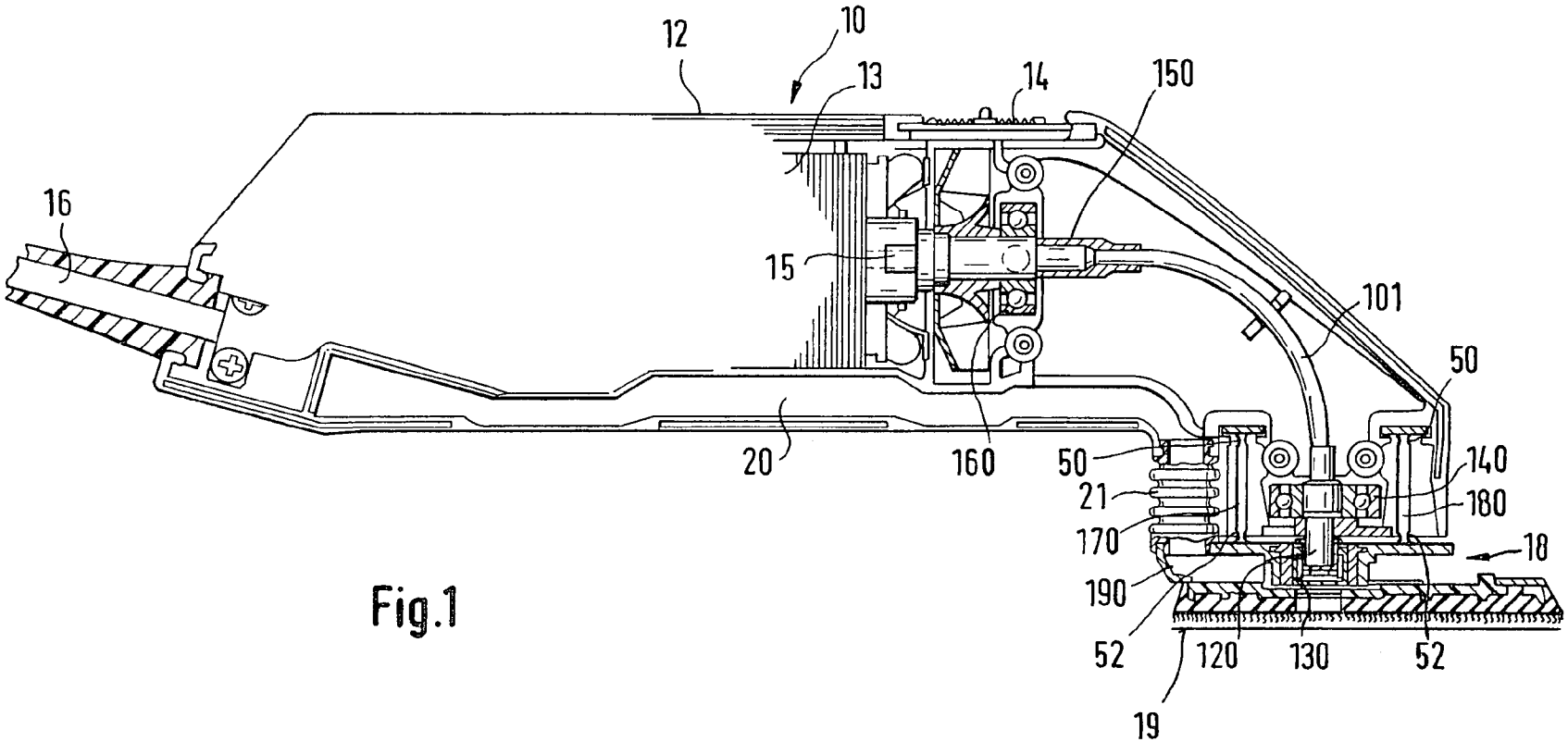
FIG. 1 is a partially cut-away side view of the hand-operated orbital sander according to the invention.

The hand-operated orbital sander 10 shown in FIG. 1 comprises a longitudinal machine housing 12 serving as a handle that accommodates an electric motor 13. A slide switch 14 for turning the motor 13 on and off is situated on the top of the machine housing 12.

An electrical connector cable 16 extends out of the back of the machine housing 12.

From there, a grinding plate 18 is located on the machine housing 12 to detachably accommodate an abrasive disc 19. Rotations of the motor 13 are transferred to the grinding plate 18 via a flexible shaft 101. One end of said flexible shaft ends in an eccentric bolt 120, with which it is turnably supported via a needle bearing 130 on the grinding plate 18. Additionally, the flexible shaft is turnably supported via its first end in a lower rolling bearing 140 in the machine housing 12 above and immediately adjacent to the eccentric bolt 120. On the motor side, the flexible shaft 101 is coupled via a push fit coupling 150 with a motor shaft not described in greater detail. Additionally, the flexible shaft 101 is turnably supported in a top rolling bearing 160 in the machine housing 12 in the vicinity of the push fit coupling 150.

The grinding plate 18 is mounted on the machine housing 12 via leaf spring-like oscillating elements 170, 180 in a manner that safeguards it against loss and rotation. A bellows 21, as an elastic connection element, is located between the grinding plate 18 and the machine housing 12. Dust that is produced underneath the grinding disc 18 can flow through said bellows even though said grinding disc makes an oscillating motion.

A constriction and/or tapered area 50, 52 is located on each of the top and bottom ends of the oscillating elements 170, 180, by way of which said constriction or tapered area each of the elastic bars functions like a cardan shaft. This minimizes loss of power, because the dampening of the grinding plate oscillation is reduced to the requisite degree. In addition, this markedly improves the quietness of operation of the sanding/grinding hand power tool.

FIGS. 3 and 4 show the rear and front elastic oscillating elements 170, 180 that are composed of a top and bottom transverse leaf 55, 57, between each of which three individual elements designed in the shape of columns extend. Each individual oscillating upright has a tapered area 50, 52 in the vicinity of the transverse leaves (55, 57).

The oscillating element 180 located on the tip of the grinding plate 18 and shown in FIG. 4 is composed of the transverse leaves 59, 60, between which four individual oscillating uprights with tapered areas 50, 51 extend. The efficiency of the oscillating element 180 is improved by the tapered area 50, 52 in the same manner as it is with the oscillating element 170 shown in FIG. 3.

In a not-shown exemplary embodiment, two concave, semicylindrical recesses are located transversely to the oscillating elements facing away from each other in the same location, as opposed to circumferential constrictions and/or tapered areas. A film hinge is formed as a result, which said film hinge is capable of being deformed with great flexural softness transversely to the axis of the recesses, and with markedly greater bending stiffness parallel to the axis of the recesses. When oscillating elements of this nature are used, it is therefore possible to approximately attain the oscillating behavior of a linear sander.

What is claimed is:

1. A hand-operated orbital sander (10) with a housing (12) on which a tool (18) capable of being moved in an oscillating manner is mounted, whereby the orbital path of the tool (18) is limited by longitudinal, elastic oscillating elements that couple the tool (18) with the housing (12), wherein the oscillating elements (170, 180) each comprises first and second tapered areas (50, 52) positioned at a distance from each other, wherein each of the first and second tapered areas is closely adjacent to an end of the oscillating element, wherein each of the first and second tapered areas of the oscillating elements (170, 180) is configured as two opposite, concave, recesses, wherein said recesses form a film hinge, wherein said film hinge has a bending resistance in a direction transverse to the recesses that is less than a bending resistance in a direction parallel to said recesses.

2. The hand-operated orbital sander according to claim 1, wherein each of the first and second tapered areas (50, 52) of the oscillating elements (170, 180) is configured as a circumferential constriction about the circumference of each oscillating element.

3. The hand-operated orbital sander according to claim 1, wherein each of the oscillating elements (170, 180) has a transverse leaf (55, 57, 59, 60).

* * * * *